US005216761A

United States Patent [19]

Isberg

[11] Patent Number: 5,216,761

[45] Date of Patent: Jun. 8, 1993

[54] FLUSH VOLUME CONTROLS FOR TOILETS

[76] Inventor: Per G. Isberg, 14320 168th Ave. NE., Woodinville, Wash. 98072

[21] Appl. No.: 803,124

[22] Filed: Dec. 4, 1991

[51] Int. Cl.[5] ..... E03D 1/14; E03D 1/00

[52] U.S. Cl. ..... 4/324; 4/325; 4/415

[58] Field of Search ..... 4/324, 325, 331, 378, 4/394, 396, 397, 415

[56] References Cited

U.S. PATENT DOCUMENTS

| | | | |
|---|---|---|---|
| 4,937,895 | 7/1990 | Stevens | 4/325 |
| 4,945,578 | 8/1990 | Jomha et al. | 4/324 |
| 5,040,247 | 8/1991 | Stevens | 4/324 |
| 5,073,995 | 12/1991 | Jennison et al. | 4/415 |
| 5,086,524 | 2/1992 | Stevens | 4/325 |

*Primary Examiner*—Henry J. Recla
*Assistant Examiner*—David J. Walczak
*Attorney, Agent, or Firm*—Hughes and Multer

[57] ABSTRACT

Flush volume control devices for flush type toilets equipped with a valve which is opened to allow flush water to flow from the toilet into its bowl and then closed. The flush volume control engages a pivotably mounted, flapper valve bracket as the level of flush water in the toilet tank recedes upon the toilet being flushed and thereafter continues downwardly, displacing the valve to a closed position even though a considerable volume of water may remain in the tank. This provides a reduced volume flush of the toilet bowl. A vertically adjustable float component of the control allows the flush volume to be changed between wide limits at will. A full flush—i.e., one of substantially the entire contents of the tank—can be produced merely by holding the existing flush lever in its flushing position until the toilet tank has emptied.

6 Claims, 5 Drawing Sheets

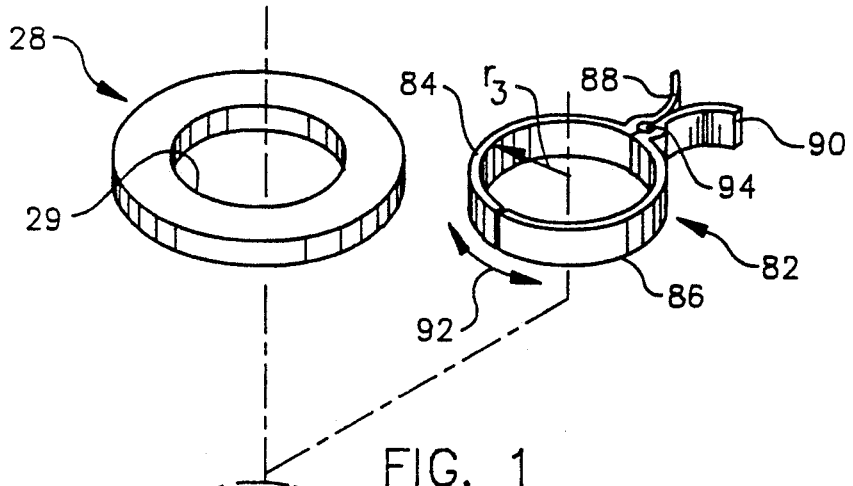
FIG. 1
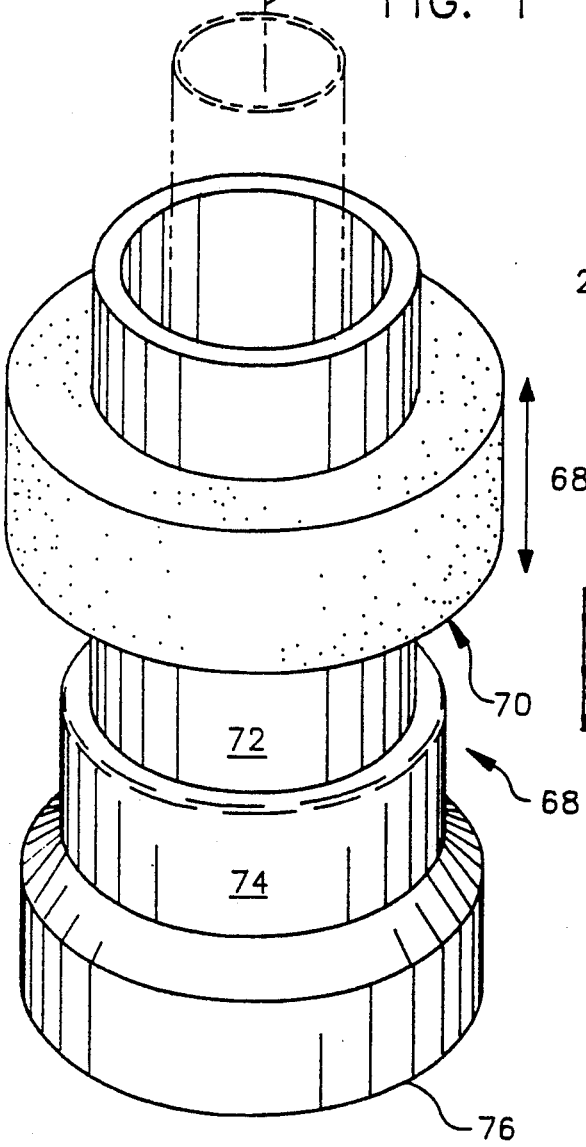
FIG. 2
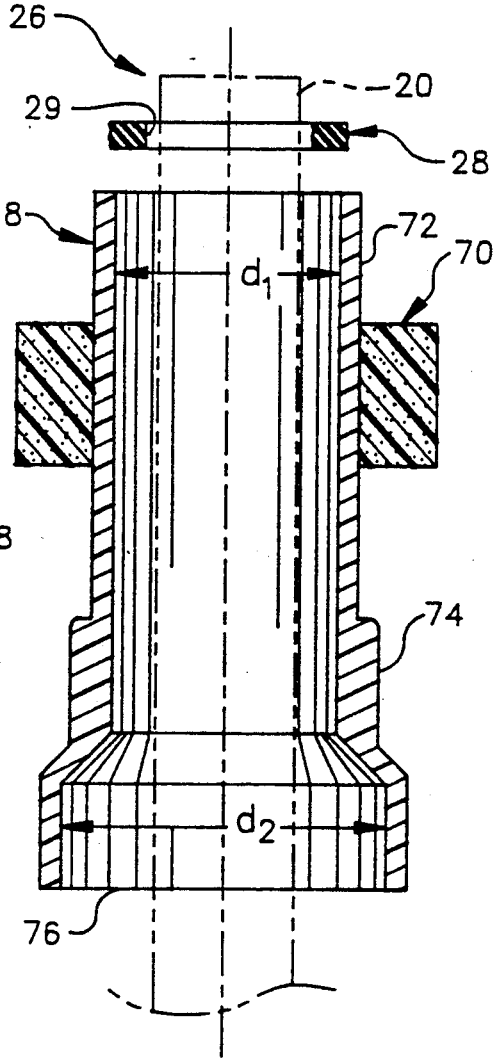

FLUSH VOLUME CONTROLS FOR TOILETS

TECHNICAL FIELD OF THE INVENTION

The present invention relates to novel, improved devices for saving water and, more particularly, to flush volume controls which can be employed to reduce to a selectable level the amount of water used when a toilet is flushed, but which allow the control to be operationally bypassed and the toilet flushed with the entire volume of water in the tank when that is appropriate.

BACKGROUND OF THE INVENTION

Enormous quantities of otherwise utilizable water are consumed in flush type toilets. As populations increase, there is greater pressure on available water supplies and considerable incentive to more effectively utilize those supplies. This has led to a number of proposals which would reduce the volume of liquid utilized when a tank type toilet is flushed.

At the same time, it is desirable that a user be able to selectively flush the toilet with the entire volume of water in the toilet tank when circumstances dictate, for example when solid waste is present in the toilet bowl. Consequently, water saving devices for toilets are typically so constructed that a user can cause either a reduced volume flush or a full flush to occur.

A number of water saving devices which have these objectives in mind employ two flush handles. One is employed for a reduced volume flush and the other for a full volume flush. These systems have the disadvantage of being expensive due to the considerable number of parts required by what are essentially two complete flushing systems. Furthermore, a tank specially constructed to make the flush levers of both systems accessible from the exterior of the toilet's tank are required. This involves additional expense, limits the market for the system, and eliminates the possibility of retrofitting existing toilets.

Other, heretofore proposed, water saver systems employ a single flush lever which can be: (a) rotated in opposite directions for reduced and full volume flushes, or (b) depressed to one position for a reduced volume flush and to a second position for a second, higher volume flush. For the most part, existing toilets can be retrofitted with flushing systems of this character. However, these systems are nevertheless characterized by a larger than optimal number of components; and their ability to conserve flush water is often less than optimal. This is because children and others will often forget which position of direction of rotation generates a reduced volume flush and therefore inadvertently produce a full volume flush in circumstances where a flush of that magnitude is not necessary.

Yet another disadvantage common among both the heretofore proposed single and dual handle water savers are installation requirements that may exceed the capability of the average user and a concomitant difficulty in adjusting the substituted mechanism or mechanisms so that they will function properly.

Also, the prior art water saver systems typically make no provision for adjusting the volume of water flushed through the toilet when a reduced volume flush is initiated or allow changes in this volume to be made only with considerable difficulty.

In short, there is an existing and continuing need for improved water savers for flush toilets.

SUMMARY OF THE INVENTION

Such systems have now been invented and are disclosed herein. These novel systems have only three, inexpensively fabricated components. They are easily installed, a process which can be accomplished without tools. Flush controls as disclosed herein are furthermore retrofittable to existing toilets; and they minimize the possibility that the user will inadvertently initiate a full flush when one of reduced volume is intended.

The novel flush volume control devices disclosed herein have only an elongated flapper valve actuator and a float, together with an associated stop. The elongated member is slidably mounted on the overflow pipe of the toilet in which the control is installed. The lower segment of that component is of enlarged diameter and thereby made capable of engaging the vertically pivotable bracket on which the flapper valve that is opened to discharge water from the tank of a flush type toilet is mounted. The float has a complementary, cylindrical configuration and is mounted on the cylindrical component in a frictional relationship which: (a) allows the float to be adjusted up and down on the flapper valve actuator but which is capable of generating sufficient friction to retain the float in the position to which it is adjusted.

The control-associated stop 28—a washerlike element with a central aperture 29 fabricated from an eleastically deformable polymer—is installed on the overflow pipe above the flush volume control. It keeps the control from floating upward to a level at which it might stick or otherwise become inoperative as the water level in the toilet tank rises and the float of the flush volume control moves that device upwardly.

When the toilet equipped with the flush volume control is flushed, gravity moves the flush volume control downwardly as the level of water in the toilet tank drops. This results in the elongated actuator component engaging the flapper valve-supporting bracket and pivoting that bracket downwardly. The result of this is that the flapper valve is moved downwardly to its water outlet blocking position while there is still a considerable volume of water in the tank instead of the flapper closing only after the tank has been emptied as it is in the normal operation of a flush toilet. By adjusting the float up and down on the valve support-engaging component of the flush volume control, different fractions of the elongated component can be caused to remain under water as the level drops. With the float in an upper position, a greater length will be kept under water; the bottom end of that member will engage the flapper valve-supporting bracket sooner; and the flapper valve will close sooner, trapping a larger volume of water in the toilet tank than is the case where the float is adjusted to a lower position on the actuator and a shorter part of the elongated component is kept under water. That results in the flapper valve-supporting bracket being engaged later in the flush cycle and the flapper valve being closed only after a greater volume of water has been discharged from the tank.

When wanted, the tank can be emptied to furnish a full flush of larger volume simply by keeping the flush lever depressed and the flapper valve away from the tank outlet until all of the water in the tank is gone.

Aside from drastically simplifying the number of components needed to provide both small volume and full flushes, the present invention has the advantage of virtually eliminating the possibility that a full flush will be initiated when only a partial flush is wanted as a full volume flush requires a deliberate act lasting over an extended period of time.

As will be apparent to the reader, one primary and important object of the present invention resides in the provision of novel, improved flush volume controls for flush type toilets.

Other important objects, advantages, and features of the present invention will be apparent from the foregoing and the appended claims and as the ensuing detailed description and discussion proceeds in conjunction with the accompanying drawings.

BRIEF DESCRIPTION OF THE DRAWINGS

FIG. 1 is a perspective view of a flush volume control for flush toilets which embodies the principles of the present invention and a pair of associated and alternatively employable control movement limiting stops FIG. 2 is a vertical section through the flush volume control and one of the two stops illustrated in FIG. 1, both as installed on the overflow pipe of a conventional flush toilet.

DETAILED DESCRIPTION OF THE INVENTION

Figure 3:
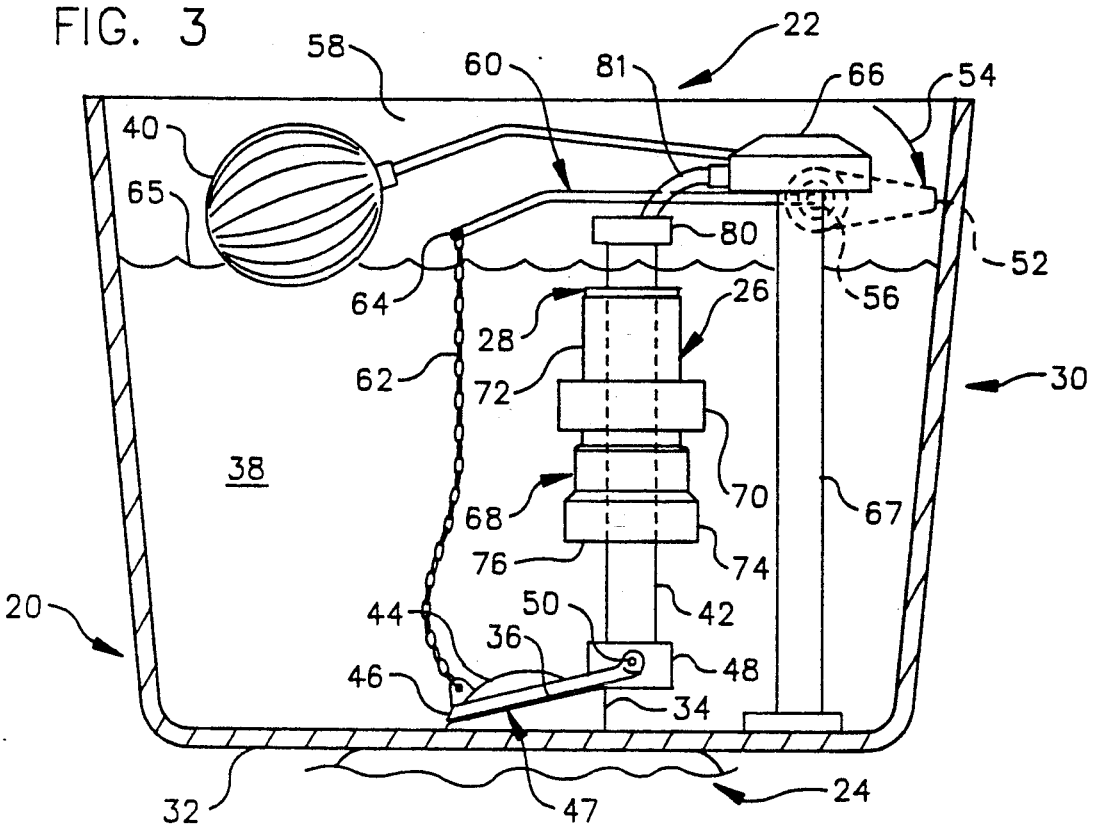
FIG. 3 is a section through the toilet tank with the flush volume control and stop installed in a configuration which will produce a partial flush of maximum volume when the flush lever of the toilet is depressed to flush the toilet.

Referring now to the drawings, FIGS. 3–10 depict a flush type toilet with a tank 22 and a bowl 24. Toilet 20 is equipped with a flush volume control 26 employing the principles of the present invention and an associated stop 28. Toilet 20 is representative of toilets equipped initially with a flush volume control as disclosed herein and of toilets retrofitted with a flush control of that character.

Toilet tank 22 is conventional in character. It includes a casing or housing 30 with an open upper end. Adjacent the bottom wall 32 of the housing is a hollow fitting 34 with a beveled outlet and flapper valve seat 36 through which flush water 38 can be discharged from tank 22.

Also found in the casing 30 of toilet tank 22 are the conventional flush toilet float 40, vertically extending overflow pipe 42, and flapper valve 44 shown in the drawings. Flapper valve 44 is mounted for vertical movement relative to outlet 36 between the lower, closed position shown in FIG. 3 and the upper, open position shown in FIG. 4 at one end 46 of a flapper valve bracket 47. At its opposite end, the flapper valve bracket 47 is attached to a structural member depicted schematically and identified by reference character 48 for pivotable movement about a horizontal axis as by pivot pin 50.

Figure 4:
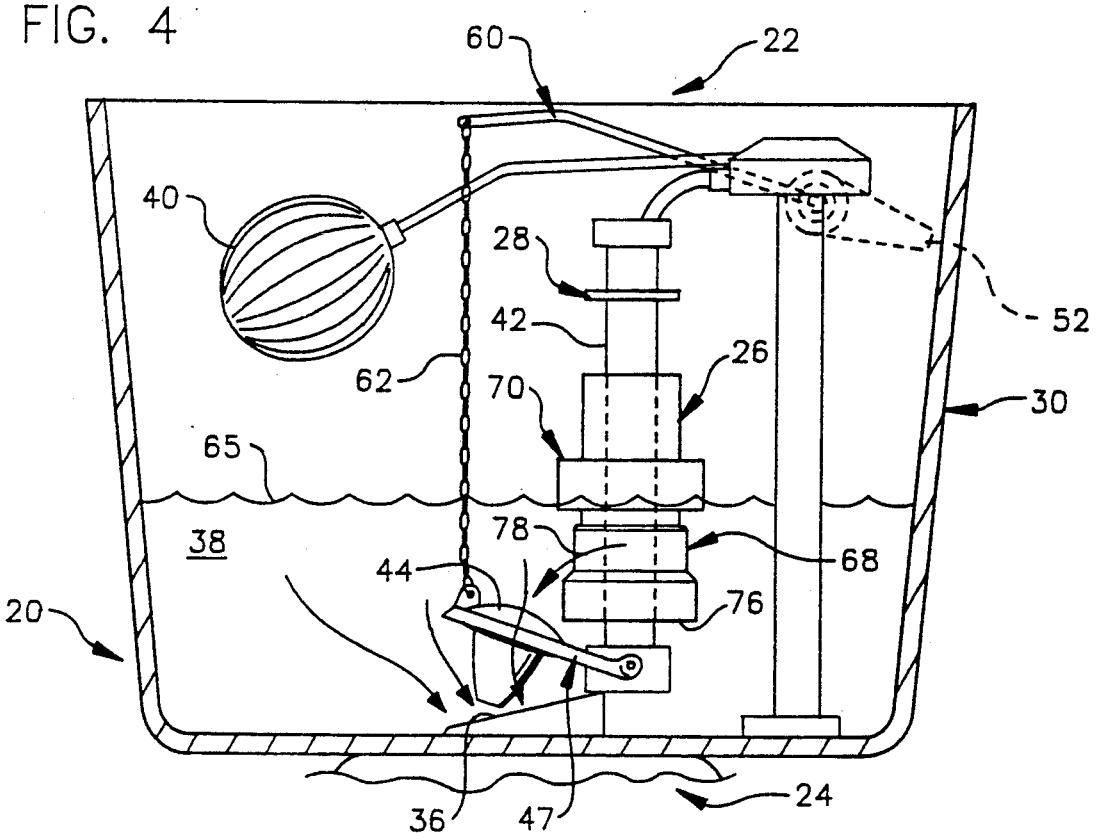
FIG. 4 is a view similar to FIG. 3 but with the flush lever activated to open the flapper valve in the toilet tank and allow water to flow through the tank outlet to flush the toilet bowl.

Flapper valve 44 is elevated to the open position shown in FIG. 4 to allow flush water 38 to flow through outlet 36 into toilet bowl 24. This is accomplished by depressing a flush lever 52 accessible from the exterior of toilet tank 22; i.e., by rotating the flush lever in a counterclockwise direction from the position shown in FIG. 3 to that shown in FIG. 4 as indicated by arrow 54 in FIG. 3.

Flush lever 52 is a crank mounted, at one end, on a crank rod 56 which extends through, and is rotatably supported in a aperture (not shown) in the front wall 58 of tank housing 30. A second crank 60 is fixed to the opposite end of crank rod 56 for rotation therewith inside tank casing 30. The free end of the second crank rod 60 is attached to the valve supporting end 46 of the flapper valve bracket 47 by a flexible, initially slack member such as the illustrated pull chain 62.

By virtue of the mechanism just described, the aforesaid rotation of flush lever 52 from the position of FIG. 3 to the flush position of FIG. 4 results in crank arm 60 rotating in a clockwise direction and, consequently, in the free end 64 of that crank moving upwardly and pulling flapper valve 44 via pull chain 60 upwardly and away from outlet/valve seat 36 to the open position depicted in FIG. 4. As discussed above, this allows flush water to flow from tank 72 into toilet bowl 24.

Aside from the conventional, and conventionally operating, components just described, toilet tank casing 30 also houses an equally conventional set of components including the above-mentioned float 40, as well as a float-controlled inlet valve 66 served by a standpipe 67, for refilling tank 22 to the level 65 illustrated in FIG. 1 once toilet bowl 24 has been flushed. The installation and operation of the novel flush volume controls disclosed herein does not involve those components, and they will accordingly not be described in detail herein.

Referring now to FIGS. 1 and 2 as well as FIGS. 3–10, flush volume control 26 includes two simple components 68 and 70; an elongated, hollow, tubular, flapper valve actuator 68 and an associated, complementary float 70, typically fabricated from a synthetic, polymeric, typically closed cell foam.

Control component or flapper valve actuator 68 has an upper pipelike element or segment 72 dimensioned for an easy sliding fit on overflow pipe 42 and an integral, bell-shaped, lower element segment 74 with an internal diameter $d_2$ which is considerably greater than the internal diameter $d_1$ of upper segment 72. This allows the control member to move downwardly over the structural component 48 to which flapper valve bracket 47 is attached so that the bottom end or lower edge 76 of component 68 can engage flapper valve bracket 47 and pivot it clockwise from the position shown in FIG. 4 to that shown in FIG. 5. That moves flapper valve 44 from the open position shown in FIG. 4 to the closed position illustrated in FIG. 5 as indicated by arrow 78 in FIG. 4 when toilet 20 is flushed and the level 65 of flush water 38 in tank 22 subsequently drops, allowing gravity to move flapper valve actuator 68 downwardly from the FIG. 4 to the FIG. 5 position.

Figure 5:
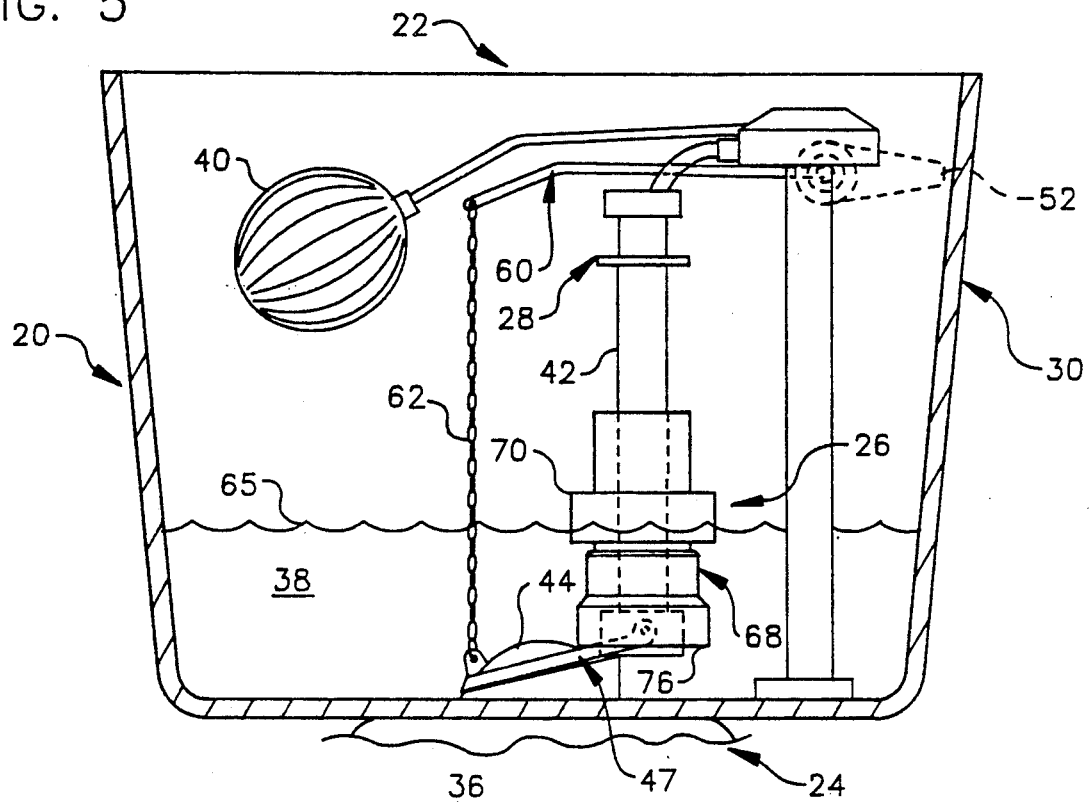
FIG. 5 is a view similar to FIGS. 3 and 4 but with the flapper valve closed by the downward movement of the flush volume control to trap water in the toilet tank and provide a partial flush.
Figure 10:
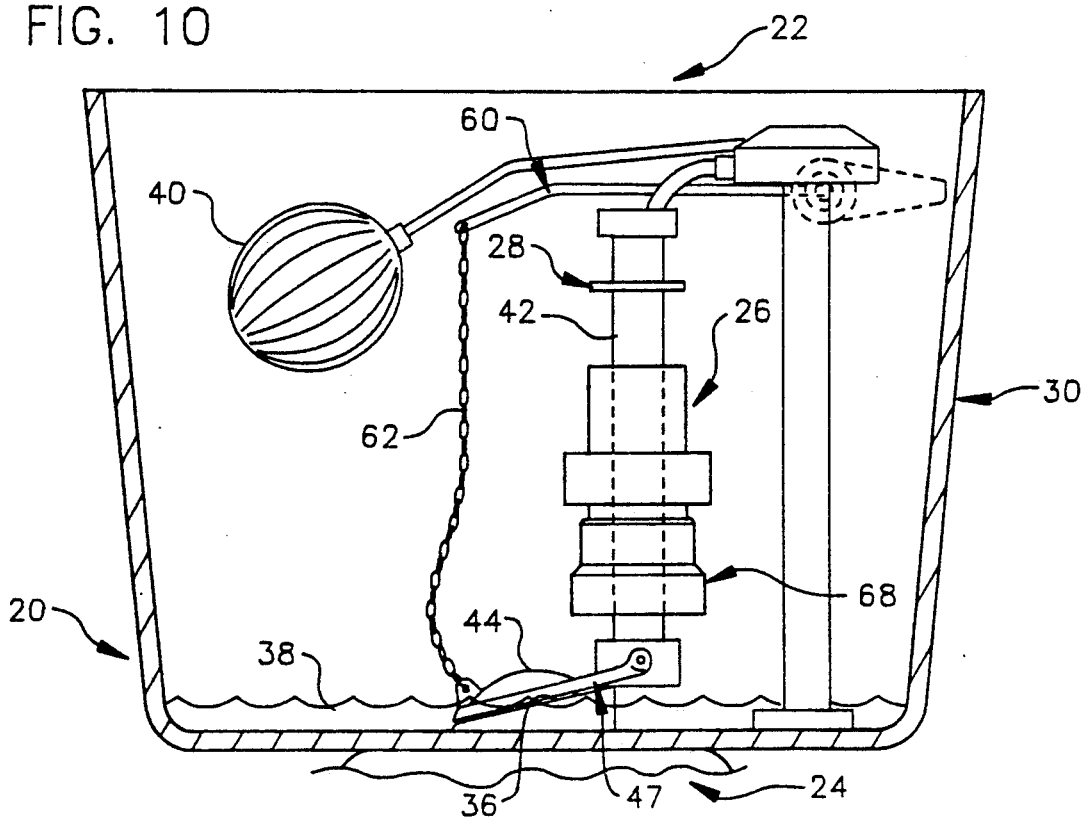
FIG. 10 is a view similar to FIG. 9 with the tank essentially emptied, allowing the flapper valve to close in the manner normal in the operation of a flush type toilet.

As is shown in FIG. 5, this results in a considerable volume of flush water 38 being trapped in tank 22 rather than in the tank being almost entirely emptied as it is in the course of a normal flush (see FIG. 10). The result is a considerable saving—25 to 75%—in the quantity of flush water 38 utilized in flushing toilet bowl 24.

Upper flapper valve actuator element 72 can be fabricated from standard PVC pipe, and lower element 74 may be a separate and conventional ABS pipe reducer bonded to the upper component with an appropraite adhesive.

Only the simplest of procedures is required to assemble and then install flush control 26. First, float 70 is installed on control component 68. Next, the top (not shown) of toilet tank 22 is removed to expose the components housed in that tank. Then, the cap 80 is unscrewed from the upper end of overflow pipe 42, and the flexible water inlet line 81 is removed from the overflow pipe. Next, flush volume control 26 is slid down over the upper end of the overflow pipe; and this is followed by fitting the frictionally retained, cylindrical stop 28 on the upper end of the overflow pipe. As discussed above, this stop keeps the flush volume control 26 from moving upwardly upon subsequent flushing of toilet 20 to a position above that illustrated in FIG. 3 in which the control might hang up on other tank housed components and become inoperative or interfere with the operation of those components.

The installation process is completed by replacing overflow pipe cap 80, reinserting the lower end of flexible water line 82 into the overflow pipe, and replacing the tank cover.

As will apparent to the reader, the installation process just described requires no expertise and only a few minutes and does not require any tools.

Figure 6:
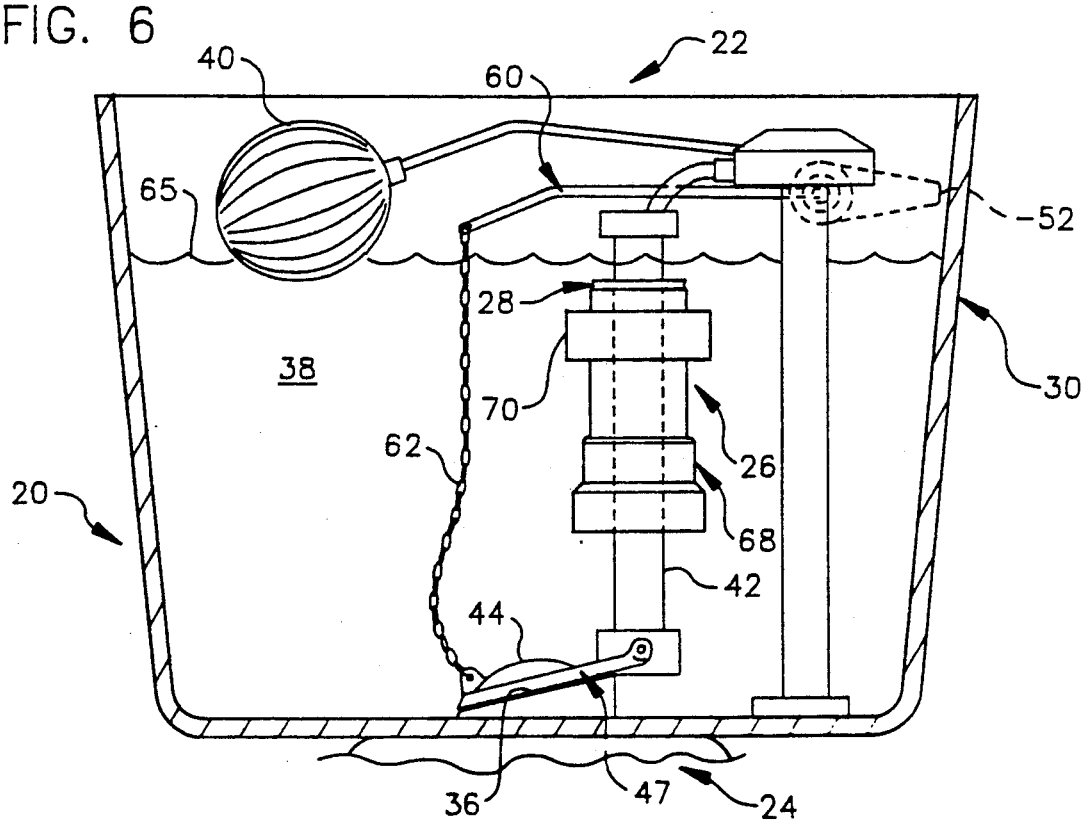
FIGS. 6–8 are like FIGS. 3–5, respectively, but with the float of the flush volume control adjusted to its highest position to decrease the volume of water discharged from the toilet tank when a partial flush is initiated.
Figure 7:
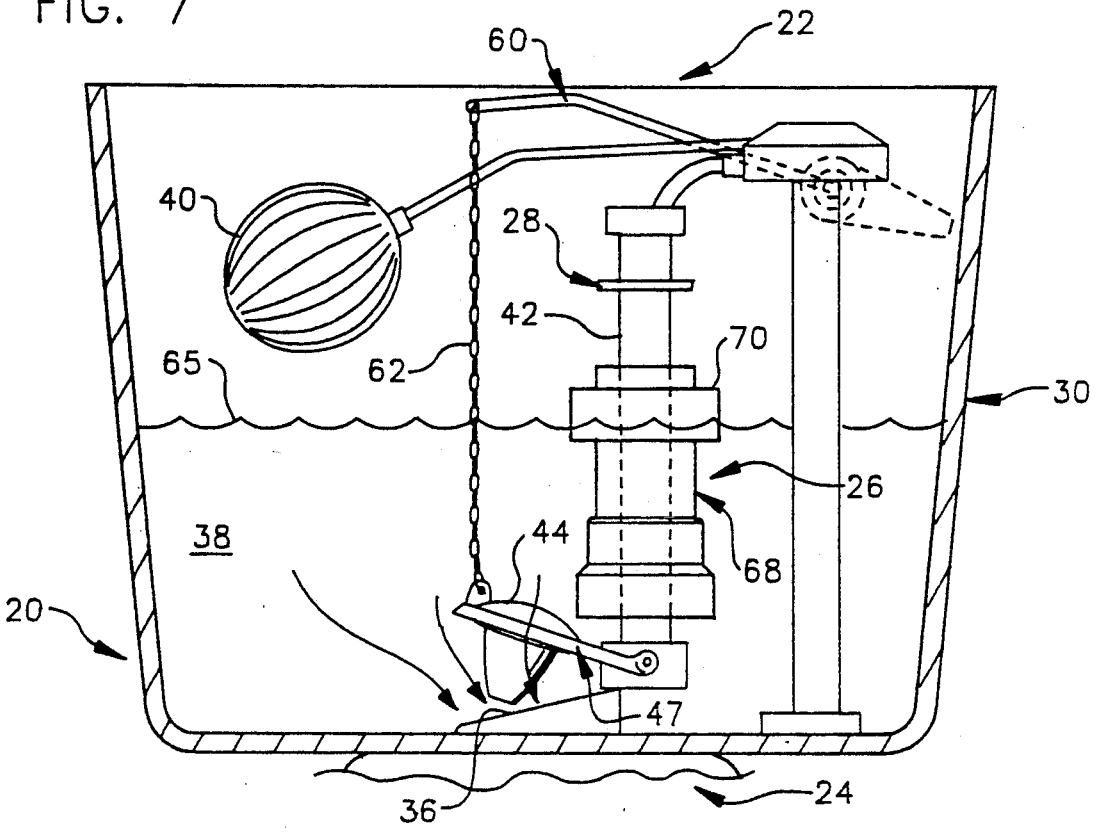
Figure 8:
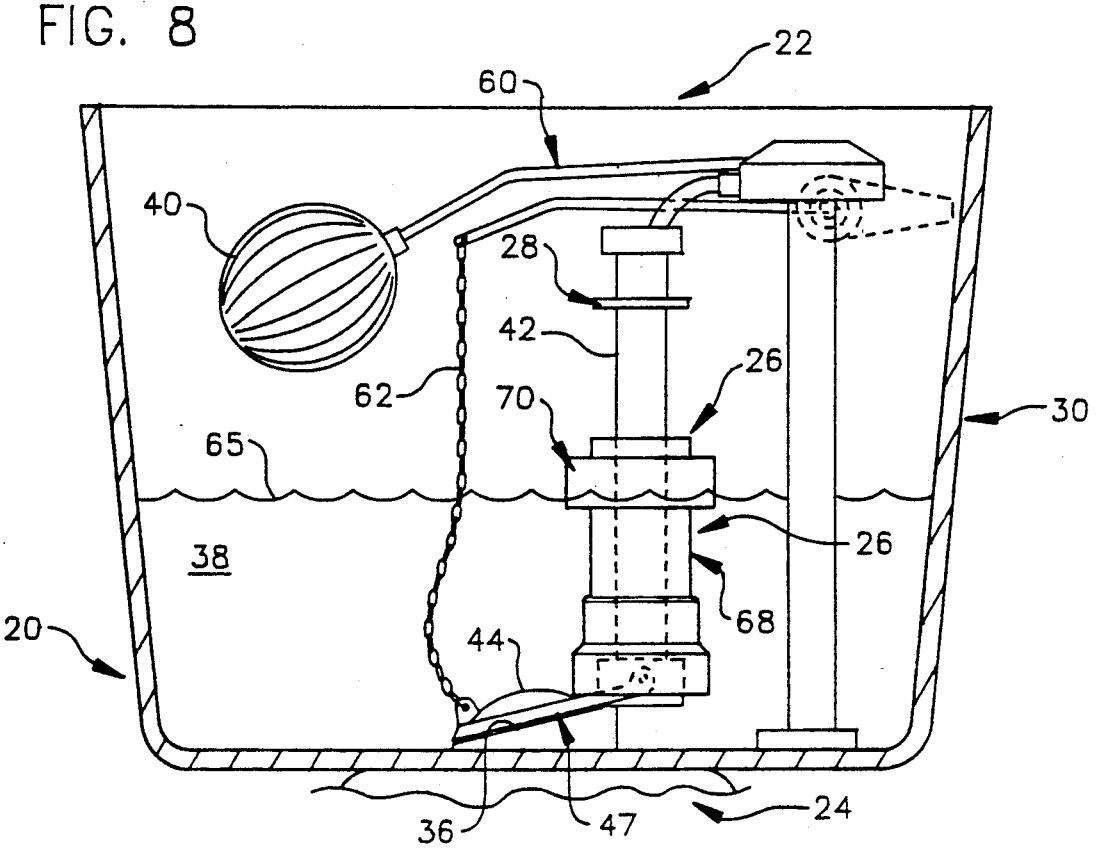

Comparing now, FIGS. 3, 4, and 5 with complementary FIGS. 6, 7, and 8, it was pointed out above that float 70 can be adjusted up and down on the upper cylindrical segment 72 of flush volume control component 68 to select and adjust the volume of flush water 38 that is discharged through tank outlet 36 when toilet 20 is flushed. Thus, FIGS. 3-5 depict toilet 20 with float 70 adjusted toward the bottom of segment 72 so that a relatively large volume of water will be discharged from tank 22 when toilet 20 is flushed by first depressing and then releasing flush lever 52. Specifically, with float 70 thus adjusted, a relatively short length $h_1$ of component 68 is held under water as the level 66 of flush water 38 in tank 22 recedes. Consequently, a large part of the available volume of flush water 38—typically, on the order of 75%—will be discharged from tank 22 before the bottom end 76 of component 68 engages flapper valve bracket 47 and pivots that bracket in the arrow 78 direction, moving the flapper valve downwardly from the open FIG. 4 position to the closed, FIG. 5 position.

Conversely, with float 70 adjusted upwardly on flush volume control component 68 as shown in FIGS. 6-8, a much longer length of component 68, as indicated by dimension $h_2$ in FIG. 8, is held under water as the level 66 of flush water 38 in tank 22 becomes lower. This means that the flapper valve bracket 47 is engaged by the lower end 76 of flush control 68 at an earlier stage in the flush cycle while the level 66 of water in the tank is higher and that the volume of flush water trapped in tank 22 when the flapper valve is subsequently closed by the pressure exerted on bracket 47 is consequently larger. Depending upon the length of the volume controls's flapper actuator 72 and the particular setting of float 70, as little as 25% of the available flush water may be discharged from tank 22 when toilet 20 is flushed.

Intermediate adjustments of float 70 on valve actuator segment 72 may of course be employed to provide flush water volumes between these representative 25 and 75% limits.

Figure 9:
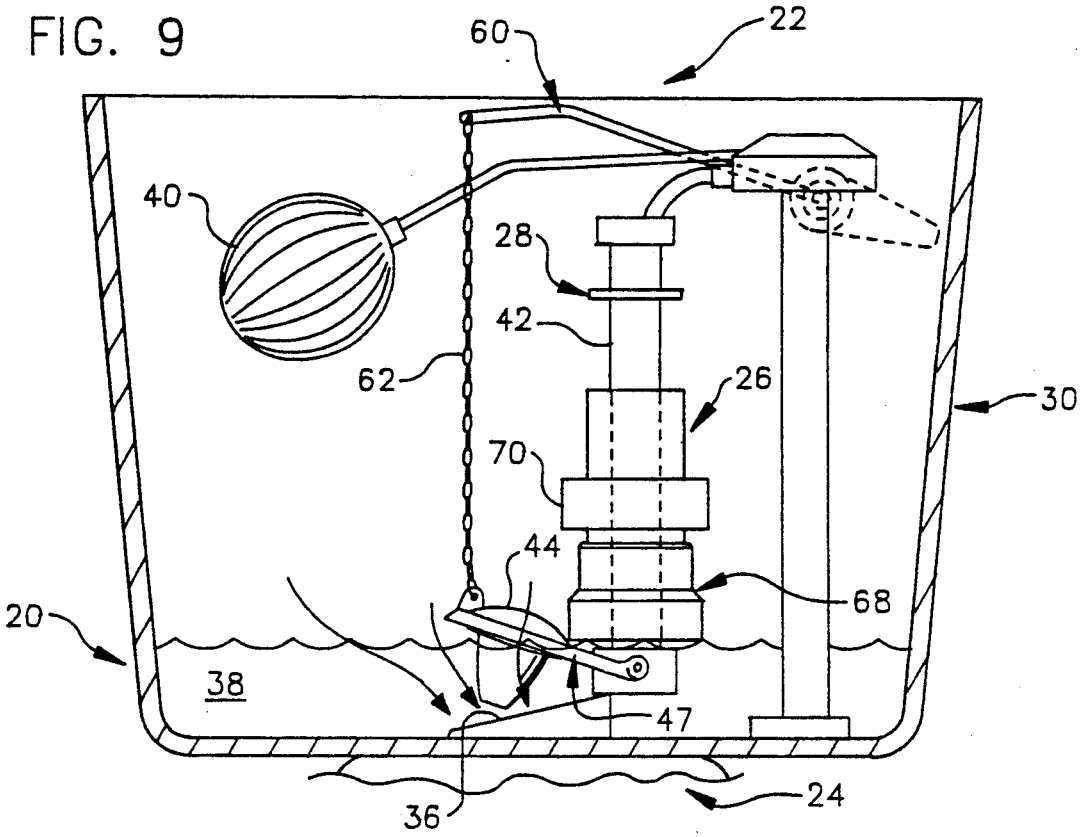
FIG. 9 is a view similar to FIG. 4 but with the flush lever of the toilet held down to keep the flapper valve open and produce a full flush.

Referring now to FIGS. 9 and 10, it is one of the virtues of flush volume control 26 that, aside from ease of installation and adjustment, it nevertheless provides for a full volume flush—i.e., the essentially complete emptying of the flush water 38 available in tank 22—when a full flush is wanted. As indicated above, a full flush may be appropriate when solids are present in toilet bowl 24. The extra flush volume insures against clogging and rinses clean of the toilet bowl.

Referring still to FIGS. 9 and 10, a full flush is effected simply and unmistakably by merely holding flush lever 52 in the operated of flushing position illustrated in FIG. 9 until tank 22 is essentially emptied as shown in FIG. 10. This allows flush volume control to move down as it does when the flush layer is first depressed and then released to initiate a partial flush. However, with flush lever 52 held in the depressed position of FIG. 9, flush crank 60 and pull chain 62 keep flapper valve 44 in the open position shown in FIG. 9 despite the gravitational, valve closing force imposed upon the flapper valve by way of flush volume control 26. Consequently, tank 22 will essentially empty, as indicated in FIG. 10. At this point, flush lever 52 can be released. That results in flush lever 52 restoring to its initialized position shown in FIG. 10, and, consequently, in pull chain 62 becoming slack and allowing flapper valve 44 to close. Thereafter, tank 22 refills in a manner customary in any flush toilet to complete the flush cycle.

Referring again to FIG. 1, an alternative to the above-described control movement-limiting stop 28 is therein pictured and identified by reference character 82. This stop, fabricated from an appropriate resilient metal or polymer, has cooperating, arcuate, overflow pipe engaging arms 84 and 86 with a radius $r_3$ complementing that of overflow pipe 42 which can be manually spread apart by pressing integral actuators 88 and 90 toward each other as indicated by arrow 92 to rotate the arms apart about pivot axis 94. This increases the internal diameter $d_3$ of stop 82, allowing it to easily be slid down overflow pipe 42 to a position akin to that occupied by stop 28 in the installation shown in FIGS. 3-10. Thereafter, actuators or grips 88 and 90 are released, whereupon arcuate stop segments 84 and 86 are resiliently biased toward each other, frictionally retaining stop 82 at the selected position on the overflow pipe.

The invention may be embodied in many forms in addition to those disclosed herein without departing from the spirit or essential characteristics of the invention. The present embodiments are therefore to be considered in all respects as illustrative and not restrictive, the scope of the invention being indicated by the appended claims rather than by the foregoing description. All changes which come within the meaning and range of equivalency of the claims are intended to be embraced therein.

What is claimed is:

1. A flush-type toilet which comprises:

a tank and a bowl;

a water outlet in the bottom of said tank;

a flapper valve for controlling the flow of water from said tank through said outlet into the bowl;

means mounting said flapper valve in said tank for movement away from said outlet to allow water to flow therethrough and toward said outlet to keep water from escaping therethrough;

a mechanism which includes an operator manipulatable flush means for moving said flapper valve away from said outlet to flush the toilet;

and an adjustable flush volume control means for actuating the flapper valve, said flush volume control means being so engageable with the flapper valve mounting means when the toilet is flushed by a single actuation of the flapper valve actuator as to displace said flapper valve toward said outlet and terminate the flow of water through the outlet after a selectable and alterable fraction of the water in said tank has flowed through said outlet;

said flush volume control means consisting in its entirety of an elongated flapper valve actuator and a float;

said flapper valve actuator having a hollow, elongated upper segment which so surrounds said overflow pipe that the actuator is supported by said overflow pipe for downward movement in the toilet tank relative thereto and an integral, hollow, lower segment which is open at its lower end and has a lower edge engageable with the flapper valve mounting means to move the flapper valve to its closed position as the flapper valve actuator moves downwardly relative to the overflow pipe; and said float being a monolithic member with a solid interior and a sliding frictional fit with the upper flapper valve actuator segment, said float being so supported by said flapper valve actuator that, when the toilet is flushed, said float determines a water level at which the flapper valve actuator's lower edge engages the flapper valve mounting means and thereafter displaces said valve to its closed position, said float being so vertically adjustable relative to said flapper valve actuator that the drop in water level which results in said lower edge engaging said mounting means, and therefore the volume of water discharged from the tank when the toilet is flushed, can be manually selected and adjusted.

2. A toilet as defined in claim 1 which includes means fixed to the overflow pipe for limiting upward movement of the flush volume control means relative to said pipe.

3. A toilet as defined in claim 1 in which said flapper valve actuator has a cylindrical member slidably mounted on the overflow pipe.

4. A toilet as defined in claim 3 in which said float surrounds and has a frictional fit with the flapper valve actuator.

5. A toilet as defined in claim 3 in which:

the flapper valve mounting means is a horizontally extending bracket with the flapper valve fixed to one end thereof;

the toilet includes a mounting structure for said bracket and means for fixing the other end of the bracket to said structure for pivotable movement about a horizontal axis; and said flapper valve actuator includes, at the lower end of, and integral with its cylindrical member, a hollow tubular element of sufficiently larger diameter than the cylindrical member as to clear the bracket mounting structure as the flush volume control means moves downwardly relative to the overflow pipe.

6. A toilet as defined in claim 1 in which the float is fabricated from a polymeric foam.

* * * * *